US011329434B2

(12) United States Patent
Lehmann et al.

(10) Patent No.: US 11,329,434 B2
(45) Date of Patent: May 10, 2022

(54) SHIELDING OF TWISTED PAIRS IN TWISTED-PAIR ELECTRICAL CONNECTORS BY MEANS OF A CONDUCTIVE POTTING COMPOUND

(71) Applicant: LEONI KABEL GMBH, Roth (DE)

(72) Inventors: Peter Lehmann, Absberg (DE); Benjamin Kiessling, Stein (DE)

(73) Assignee: BIZLINK INDUSTRY GERMANY GMBH, Roth (DE)

( * ) Notice: Subject to any disclaimer, the term of this patent is extended or adjusted under 35 U.S.C. 154(b) by 0 days.

(21) Appl. No.: 16/961,944

(22) PCT Filed: Jan. 31, 2019

(86) PCT No.: PCT/EP2019/052321
§ 371 (c)(1),
(2) Date: Jul. 14, 2020

(87) PCT Pub. No.: WO2019/149795
PCT Pub. Date: Aug. 8, 2019

(65) Prior Publication Data

US 2020/0412068 A1 Dec. 31, 2020

(30) Foreign Application Priority Data

Feb. 1, 2018 (DE) ..... 102018102253.0

(51) Int. Cl.

| | |
|---|---|
| ***H01R 13/659*** | (2011.01) |
| ***H01R 13/6599*** | (2011.01) |
| ***H01R 13/6589*** | (2011.01) |
| ***H01R 24/60*** | (2011.01) |
| *H01R 107/00* | (2006.01) |

(52) U.S. Cl.
CPC ..... *H01R 13/6599* (2013.01); *H01R 13/6589* (2013.01); *H01R 24/60* (2013.01); *H01R 2107/00* (2013.01)

(58) Field of Classification Search
CPC ..... H01R 13/6599; H01R 13/6589; H01R 24/60; H01R 2107/00
USPC ..... 439/607
See application file for complete search history.

(56) References Cited

U.S. PATENT DOCUMENTS 3,322,885 A * 5/1967 May ..... H01R 4/58 174/78
3,375,483 A * 3/1968 Phillips ..... H01R 13/6581 439/579

(Continued)

FOREIGN PATENT DOCUMENTS

CN 2676557 Y 2/2005
CN 201590084 9/2010

(Continued)

*Primary Examiner* — Alexander Gilman
(74) *Attorney, Agent, or Firm* — Tarolli, Sundheim, Covell & Tummino LLP

(57) ABSTRACT

An electrical connector for connecting a plurality of conductor pairs is provided. The electrical connector has a plurality of conductor pairs. The electrical connector has a metal housing. The metal housing comprises or defines a first region and a second region. Each conductor pair of the plurality of conductor pairs extends through the first region and the second region. The first region is provided with an electrically conductive potting compound.

10 Claims, 1 Drawing Sheet

(56) References Cited

U.S. PATENT DOCUMENTS 3,744,128 A * 7/1973 Fisher ..... H01R 13/6599 29/858
4,090,767 A * 5/1978 Tregoning ..... H01R 13/65912 439/607.41
4,614,398 A * 9/1986 Wright ..... H01R 13/6592 439/579
5,281,762 A * 1/1994 Long ..... H01R 9/0515 174/117 F
5,364,291 A * 11/1994 Hashiguchi ..... H01R 13/6582 439/607.56
5,441,424 A 8/1995 Morlion et al.
6,084,295 A * 7/2000 Horiuchi ..... H01L 24/48 257/690
6,336,826 B1 * 1/2002 Kraft ..... H01R 13/6463 439/498
6,960,823 B2 * 11/2005 Miyaki ..... H01L 23/49513 257/676
7,868,251 B2 * 1/2011 Gladd ..... H02G 15/025 174/72 A
8,647,149 B2 * 2/2014 Tanaka ..... H01R 9/0512 439/579
9,691,514 B2 * 6/2017 Snader, Jr. ..... H01B 1/02
2002/0081874 A1 * 6/2002 Kumamoto ..... H01R 13/6585 439/87
2007/0259568 A1 * 11/2007 Mackillop ..... H01R 13/6471 439/638
2011/0033190 A1 * 2/2011 Veilleux, Jr. ..... G02B 6/4284 398/117

FOREIGN PATENT DOCUMENTS

CN 203026774 U 6/2013
DE 4431723 A1 9/1994
DE 102011055509 A1 5/2013
DE 102012022004 B3 2/2014
DE 102016105465 A1 3/2016
DE 102015102703 A1 8/2016
EP 0620616 B1 1/1999
FR 2570551 A1 3/1986

* cited by examiner

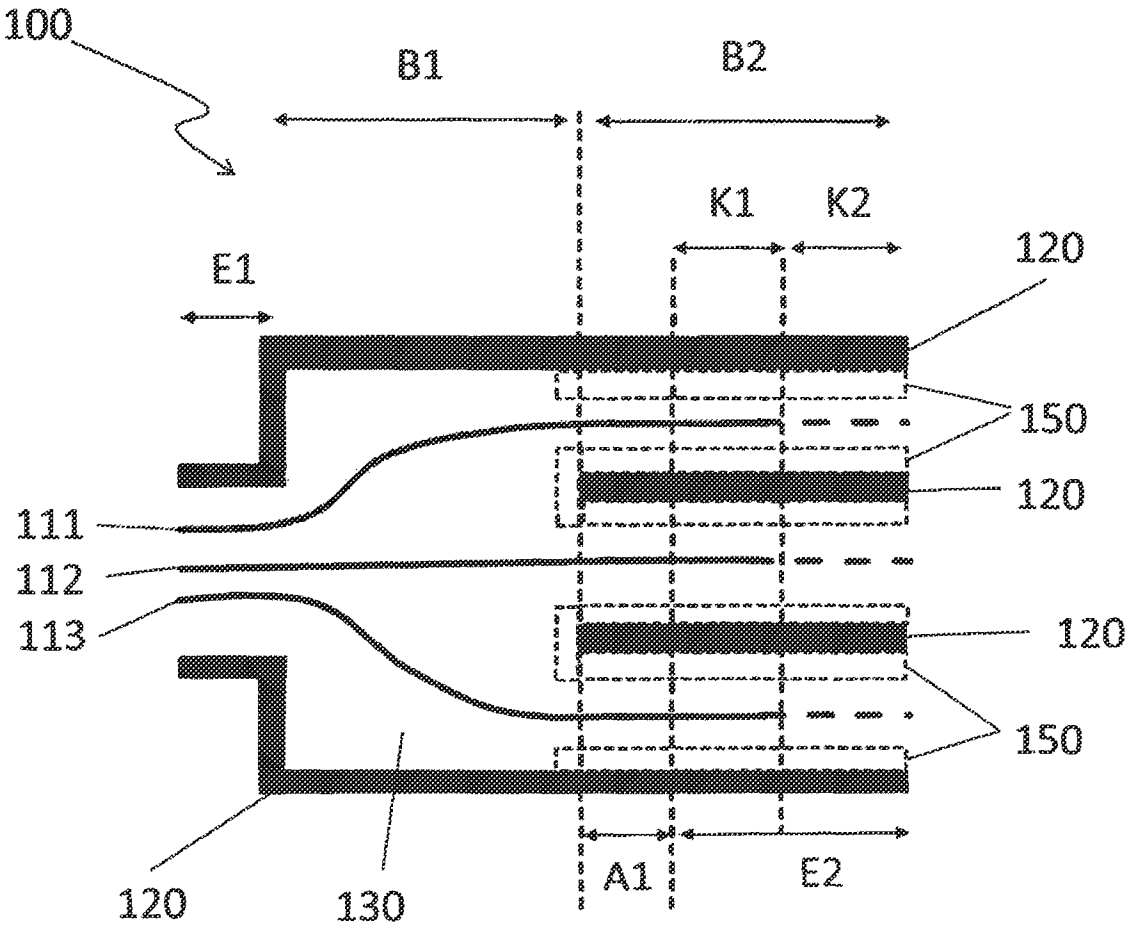
100
B1
B2
E1
K1
K2
120
150
120
120
150
111
112
113
130
120
A1
E2

SHIELDING OF TWISTED PAIRS IN TWISTED-PAIR ELECTRICAL CONNECTORS BY MEANS OF A CONDUCTIVE POTTING COMPOUND

RELATED APPLICATIONS

This application filed under 35 U.S.C § 371 is a national phase application of International Application Number PCT/EP2019/052321, filed Jan. 31, 2019, which claims the benefit of German Application No. 10 2018 102 253.0 filed Feb. 1, 2018, the subject matter of which are incorporated herein by reference in their entirety.

TECHNICAL FIELD

Examples relate to concepts for shielding a plurality of conductor pairs in an electrical connector and applications in this respect, and in particular to electrical connectors for connecting a plurality of conductor pairs.

BACKGROUND

In electrical connectors for twisted-pair cabling, which is used in the railway sector, conductor pairs run partly freely next to one another, without being shielded from one another by metal webs or housings. Especially for cables from the railway sector, and in particular for cables for moving applications, it is scarcely possible to shield conductor pairs within electrical connectors from one another, because the conductors and the insulation in twisted-pair cabling are much thicker than in standard cables. For this purpose, so-called EMC gaskets or spring elements are usually used, which can be placed in the electrical connectors afterwards.

There is therefore a need for an electrical connector which has improved shielding of the conductor pairs contained therein.

SUMMARY

Essentially, a metal housing of a (twisted-pair) electrical connector is filled by means of conductive potting compound, so that the twisted pairs in the housing are individually shielded. Twisted pairs and twisted conductor pairs are used synonymously hereinbelow.

According to one aspect, an electrical connector for connecting a plurality of conductor pairs is provided. The electrical connector has a plurality of conductor pairs. The electrical connector has a metal housing. The metal housing comprises or defines a first region and a second region. Each conductor pair of the plurality of conductor pairs runs through (or traverses) the first region and the second region. The metal housing can surround the plurality of conductor pairs in the first region and second region.

The plurality of conductor pairs can be twisted in pairs in the first region (also referred to hereinbelow as a plurality of (twisted) conductor pairs). For example, each conductor pair of the plurality of conductor pairs in the first region can be twisted. The plurality of conductor pairs can be at least partly untwisted in the second region (also referred to hereinbelow as a plurality of (untwisted) conductor pairs). For example, each conductor pair of the plurality of conductor pairs can be at least partly untwisted in the second region. The first region is provided with an electrically conductive potting compound. For example, the first region can be filled with an electrically conductive potting compound.

According to a further aspect or a further embodiment of the above-mentioned aspect, the electrical connector can be connectable or connected to a cable. The cable can be provided for guiding a plurality of conductor pairs. Furthermore, the cable can have a metal shielding for rejecting common modes.

Improved shielding of the plurality of conductor pairs from one another can thereby be ensured.

The first region can have a cavity through which the plurality of (e.g. twisted) conductor pairs are guided. The cavity can be provided with the potting compound. At least the plurality of (e.g. twisted) conductor pairs can be covered with the potting compound.

The potting compound can shield the plurality of (e.g. twisted) conductor pairs from one another.

The second region can have, for example, metal borders. The metal borders can begin, for example, at a boundary between the first and second region. The plurality of (e.g. untwisted) conductor pairs can be guided between the metal borders.

The metal borders can be part of the housing. In addition or alternatively, the metal borders can be DC-coupled with the housing.

The metal borders, together with the housing, can define connection points of the electrical connector for an electrical connector that is complementary to the electrical connector.

The metal borders can be configured and arranged to shield the plurality of (e.g. untwisted) conductor pairs from one another.

The potting compound can extend at least partly into an initial region of the second region.

The electrical connector can further have a transition portion in which the plurality of (e.g. twisted) conductor pairs is guided. The transition portion can adjoin the first region. The conductor pairs of the plurality of (e.g. twisted) conductor pairs can move apart from one another at the transition from the transition portion through the first region to the second region.

The potting compound can be a silver paste, nickel paste or a combination of the two.

It will be appreciated that the expressions used herein serve merely to describe individual embodiments and are not to be considered limiting. Unless defined otherwise, all the technical and scientific expressions used herein have the meaning so that corresponds to the general understanding of the person skilled in the art in the relevant field for the present disclosure; they are not to be interpreted either too broadly or too narrowly. If specialist expressions are used inappropriately herein and thus do not express the technical idea of the present disclosure, they are to be replaced by specialist expressions that provide the person skilled in the art with a correct understanding. The general expressions used herein are to be interpreted on the basis of the definition found in the dictionary or according to the context; too narrow an interpretation is to be avoided.

It will here be understood that expressions such as, for example, "comprise" or "have", etc. signify the presence of the described features, numbers, operations, actions, components, parts or combinations thereof and do not exclude the presence, or the possible addition, of one or more further features, numbers, operations, actions, components, parts or combinations thereof.

Although expressions such as "first" or "second", etc. may be used to describe different components, those components are not to be limited to those expressions. The above expressions are merely intended to distinguish one component from the others. For example, a first component may be referred to as a second component without departing from the scope of protection of the present disclosure; likewise, a second component may be referred to as a first component. The expression "and/or" includes both the combination of the plurality of connected objects and each object of that plurality of the described plurality of objects.

If it is stated herein that a component "is connected" to another component, is "associated" therewith or "acts thereon", this may mean that it is connected directly thereto or acts directly thereon; however, it should be noted that a further component may be located therebetween. If, on the other hand, it is stated that a component is "directly connected" to another component or "acts directly thereon", this means that further components are not present therebetween.

The preferred embodiments of the present disclosure are described hereinbelow with reference to the accompanying drawings; in the drawings, identical components are always provided with the same reference numerals. In the description of the present disclosure, detailed explanations of known associated functions or constructions are not given if they distract unnecessarily from the meaning of the present disclosure; such functions and constructions are, however, comprehensible to the person skilled in the art. The accompanying drawings of the present disclosure serve to illustrate the present disclosure and are not to be interpreted as limiting. The technical idea of the present disclosure is to be interpreted as including, in addition to the accompanying drawings, also all such modifications, changes and variants.

Further objects, features, advantages and possible applications will become apparent from the following description of exemplary embodiments, which are not to be interpreted as limiting, with reference to the accompanying drawings. All the features that are described and/or depicted in the drawings thereby show the subject-matter disclosed herein on their own or in any desired combination, also independently of their grouping in the claims or their dependencies. The dimensions and proportions of the components shown in the figures are not necessarily to scale; they may differ from those shown here in embodiments that are to be implemented.

BRIEF DESCRIPTION OF THE DRAWINGS

FIG. 1 shows a schematic representation of an electrical connector.

DETAILED DESCRIPTION

The method variants described herein and the functional and operational aspects thereof serve merely for better understanding of their structure, mode of functioning and properties; they do not limit the disclosure, for example, to the exemplary embodiments. The figures are in some cases schematic, whereby essential properties and effects are in some cases shown on a significantly enlarged or reduced scale in order to clarify the functions, active principles, technical configurations and features. Any mode of functioning, any principle, any technical configuration and any feature that is/are disclosed in the FIGURES or in the text can be combined freely and arbitrarily with all the claims, any feature in the text and in the other FIGURES, other modes of functioning, principles, technical configurations and features which are contained in this disclosure or follow therefrom, so that all conceivable combinations are to be associated with the described devices. Combinations between all the individual implementations in the text, that is to say in every section of the description, in the claims, and also combinations between different variants in the text, in the claims and in the FIGURES, are also included and can constitute the subject-matter of further claims. The claims also do not limit the disclosure and thus the possible combinations of all the indicated features with one another. All the disclosed features are explicitly also disclosed herein individually and in combination with all the other features.

The electrical connector will now be described by means of exemplary embodiments. In the following, without being limited thereto, specific details are described in order to provide a complete understanding of the present disclosure. It is, however, clear to a person skilled in the art that the present disclosure may be used in other exemplary embodiments which may differ from the details described hereinbelow.

While further examples are accordingly suitable for different modifications and alternative forms, some examples thereof are shown by way of example in the figures and described in detail herein. It will be appreciated, however, that it is not intended to limit examples to the disclosed specific forms. Further examples can cover all the modifications, correspondences and alternatives that fall within the scope of the disclosure. Throughout the description of the FIGURES, the same reference numerals refer to the same or similar elements, which may be implemented identically or in a modified form compared with one another while providing the same or a similar functionality.

It will be appreciated that, when an element is referred to as being "connected" or "coupled" with another element, the elements may be connected or coupled directly or via one or more intermediate elements. When two elements A and B are connected by "or", this is to be understood such that it discloses all possible combinations, i.e. only A, only B, as well as A and B. An alternative wording for the same combination is "at least one of A and B". The same applies to combinations of more than 2 elements.

The terminology used herein is intended to describe specific examples and is not to be limiting for further examples. Whenever a singular form such as "a", "one" and "the" Is used, and the use of only one element is neither explicitly nor implicitly defined as being compulsory, further examples may also include the plural forms in order to implement the same functionality. Similarly, when a functionality is described hereinbelow such that it is implemented using multiple elements, further examples may implement the same functionality using a single element or a single processing entity. It will further be appreciated that the expressions "comprises", "comprising", "have", "contains", "containing" and/or "having" when used herein indicate the presence of specified features, integers, steps, operations, elements and/or constituents but do not exclude the presence or the addition of one or more other features, integers, steps, operations, elements, constituents and/or groups thereof.

Unless defined otherwise, all the expressions used herein (including technical and scientific expressions) are used in their usual meaning in the field to which the examples belong.

FIG. 1 shows a schematic representation of an electrical connector 100 for connecting a plurality of conductor pairs 111, 112, 113. Each of the plurality of conductor pairs 111, 112, 113 can be provided for joint or separate signal transmission/information transmission. The electrical connector 100 comprises a plurality of conductor pairs 111, 112, 113. The electrical connector 100 comprises a metal housing 120. The metal housing 120 can be provided to shield the plurality of conductor pairs 111, 112, 113 (from electromagnetic fields outside the electrical connector 100). The metal housing can surround the plurality of conductor pairs in the first region B1 and the second region B2. The metal housing 120 comprises or defines a first region B1 and a second region B2. Each conductor pair of the plurality of conductor pairs 111, 112, 113 runs through (or traverses) the first region B1 and the second region B2. The plurality of conductor pairs 111, 112, 113 can be located within the first region B1 and the second region B2, or arranged within the first region B1 and the second region B2. The plurality of conductor pairs 111, 112, 113 can be twisted in pairs (each pair separately) in the first region B1. The plurality of conductor pairs 111, 112, 113 can be untwisted (at least partly) in the second region B2. The first region B1 is provided (filed) with an electrically conductive potting compound.

For example, the plurality of conductor pairs 111, 112, 113 can comprise or be greater than or equal to 2 or 3 or 4 or 5 or 6 or 7 or 8 conductor pairs.

For example, the plurality of conductor pairs 111, 112, 113 can be untwisted in pairs in an end region E2 of the second region B2. The plurality of conductor pairs 111, 112, 113 can be spaced apart from one another (run parallel) in pairs in the end region E2 of the second region B2. Accordingly, each conductor of the plurality of conductor pairs 111, 112, 113 can be connectable or connected separately to a conductor of a plurality of conductor pairs of a complementary electrical connector.

For example, the first region B1 can have a cavity 130. The plurality of (twisted) conductor pairs 111, 112, 113 can have been guided or can be guided through the cavity. The cavity 130 can be provided or filled with the potting compound. At least the plurality of (twisted) conductor pairs 111, 112, 113 can be covered with the potting compound.

For example, the potting compound can shield the plurality of (twisted) conductor pairs 111, 112, 113 from one another.

For example, the second region B2 can have metal borders 120. The metal borders 120 can begin at a boundary between the first region B1 and the second region B2. The plurality of (untwisted) conductor pairs 111, 112, 113 can be guided between the metal borders 120.

For example, the metal borders 120 can be part of the housing 120. The metal borders 120 can also be DC-coupled with the housing 120. For example, the metal borders in part of the second region 2 (for example in the second region K2 of the end region E2) each have receivers for an electrical connector that is complementary to the electrical connector 100.

For example, the metal borders 120, together with the housing 120, can define connection points of the electrical connector 100 for the electrical connector that is complementary to the electrical connector 100.

For example, the metal borders 120 can be configured and arranged to shield the plurality of (untwisted) (and some of the twisted) conductor pairs 111, 112, 113 from one another.

For example, the potting compound can contact the metal borders 120. Improved shielding can thereby be achieved.

For example, the potting compound can extend at least partly into an initial region A1 of the second region B2. Because the potting compound is able to flow into the initial region A1 of the second region B2, improved shielding can likewise be achieved.

For example, the electrical connector 100 can further comprise one or more insulations. The one or more insulations can correspondingly have two chambers between the metal borders 120. Each chamber can be configured and arranged to guide a respective conductor of a corresponding conductor pair of the plurality of (untwisted) conductor pairs 111, 112, 113.

For example, the one or more insulations can be provided to insulate the metal borders 120 from the corresponding conductor pairs of the plurality of (untwisted) conductor pairs 111, 112, 113. Furthermore, the one or more insulations can correspondingly be arranged and configured to insulate conductors of a conductor pair of the plurality of (untwisted) conductor pairs 111, 112, 113 from one another.

For example, the electrical connector 100 can further have a transition portion E1. The plurality of (twisted) conductor pairs 111, 112, 113 can be guided in the transition portion E1. The transition portion E1 can adjoin the first region B. The plurality of (twisted) conductor pairs 111, 112, 113 can move apart from one another (spread out) at the transition from the transition portion E1 over the first region B1 to the second region B2.

For example, the plurality of (twisted) conductor pairs 111, 112, 113 can each have a metal shielding at least in the transition portion E1. The metal shielding can be provided to shield the plurality of (twisted) conductor pairs 111, 112, 113 from one another. The plurality of conductor pairs 111, 112, 113 shielded by the shielding (and twisted) can contact one another in the transition portion E1. The electrical connector 100 can be connectable or connected to a cable (not shown). The cable can be provided for guiding the plurality of conductor pairs. Furthermore, the cable can have a metal shielding for rejecting common modes. The cable can be connectable or connected directly to the transition portion E1, or extend at least partly into the transition portion E1. This metal shielding can extend into the transition portion E1 and/or be connected to the metal housing 120. The (twisted) conductor pairs of the plurality of conductor pairs 111, 112, 113 can be stranded with one another in the cable. Furthermore, a metal shielding can be applied to the stranded conductor pairs of the plurality of conductor pairs 111, 112, 113. There can be a separate metal shielding around each conductor pair of the plurality of conductor pairs 111, 112, 113. Each metal shielding of the corresponding conductor pair of the plurality of conductor pairs 111, 112, 113 can extend over the transition portion E1 into the first region B1. Each metal shielding of the corresponding conductor pair of the plurality of conductor pairs 111, 112, 113 can extend, for example, only into the first region B1 and, for example, not into region B2.

Since the metal shielding may be too large to be guided into the region B2, the potting compound can provide a solution here, since it has no difficulty, on application, in penetrating at least into an initial region A1 of the region B2. Reliable shielding of the conductor pairs from one another can accordingly be ensured.

A plurality of conductor pairs herein is a "twisted plurality of conductor pairs 111, 112, 113" when, for example, the plurality of conductor pairs 111, 112, 113 are twisted in a region within the metal housing 120. Furthermore, a plurality of conductor pairs herein is an "untwisted plurality of conductor pairs 111, 112, 113" when, for example, the plurality of conductor pairs 111, 112, 113 are untwisted in a region within the metal housing 120.

For example, the potting compound can be a silver paste. For example, the potting compound can be a nickel paste. For example, the potting compound can be a combination of the two.

For example, each chamber can be arranged at least in a part of the second region B2. Each chamber can be arranged at least in the end region E2 of the second region B2. Each chamber can have a first portion K1. A corresponding conductor pair of the plurality of (untwisted) conductor pairs 111, 112, 113 can be arranged in the first portion K1. Exactly two chambers can be provided for each conductor pair 111, 112, 113. Each chamber can have a second portion K2, in which the chamber for connection with an electrical connector that is complementary to the electrical connector 100 has along a wall of the chamber a metal layer which is DC-coupled with the corresponding conductor and can be connected to the complementary electrical connector. Each chamber can also have the metal layer along the wall of the chamber in the end region E2 for connection with the electrical connector that is complementary to the electrical connector 100.

For example, the conductors of the plurality of conductor pairs 111, 112, 113 can each have an insulating layer (e.g. polyethylene, PE). The insulating layer can be omitted/left off, for example, in the end region E2 of the second region B2. The chambers within the end region E2 of the second region B2 can here be provided, for example, with a metal layer, so that, at the transition from the initial region A1 of the second region B2 to the end region E2 of the second region B2, the respective conductor of the plurality of conductor pairs 111, 112, 113 without insulation can be DC-coupled with the metal layer.

For example, the insulating layer can also be omitted/left off in a second portion K2 of the end region B2. The chambers within the second portion K2 of the end region E2 can here be provided, for example, with a metal layer, so that, at the transition from a first portion K2 of the end region E2 (which adjoins the initial region A1) to the second portion K2 of the end region E2, the respective conductor of the plurality of conductor pairs 111, 112, 113 without insulation can be DC-coupled with the metal layer.

The individual portions or regions can adjoin/contact one another in the following order: E1, B1, B2; E1, B1, A1, E2; and E1, B1, A1, K1, K2.

Further details and aspects are mentioned in connection with the exemplary embodiments described hereinabove and hereinbelow. The exemplary embodiment shown in FIG. 1 can have one or more optional additional features which correspond to one or more aspects which are mentioned in connection with the proposed concept or one or more exemplary embodiments described hereinabove or hereinbelow.

According to one aspect, the metal housing (120) can be filled completely with an electrically conductive potting compound (e.g. silver paste or nickel paste). The entire space between the exposed pairs (of the plurality of conductor pairs) can be filled with the potting compound. The pairs can accordingly be shielded. The potting compound can also be electrically conductively connected to the individual pair shields and the housing.

The aspects and features which have been mentioned and described together with one or more of the examples and FIGURES described in detail hereinbefore can further be combined with one or more of the other examples in order to replace a similar feature of the other example or in order additionally to incorporate the feature into the other example.

The description and drawings constitute only the principles of the disclosure. Furthermore, all the examples given here are expressly to serve only for teaching purposes, in order to assist the reader in understanding the principles of the disclosure and the concepts contributed by the inventor(s) to the further development of the art. All statements made herein relating to principles, aspects and examples of the disclosure and also specific exemplary embodiments thereof are to include their correspondences.

Furthermore, the following claims are hereby incorporated into the detailed description, where every claim can itself constitute a separate example. When every claim can itself constitute a separate example, it is to be noted that—although a dependent claim in the claims can relate to a specific combination with one or more other claims—other exemplary embodiments can also include a combination of the dependent claim with the subject-matter of any other dependent or independent claim. These combinations are proposed here, unless it is stated that a specific combination is not intended. Furthermore, features of a claim are also to be included for any other independent claim, even if that claim is not made directly dependent on the independent claim.

The present disclosure is of course not limited in any way to the embodiments described above. On the contrary, many possibilities for modifications thereof will be apparent to an average person skilled in the art, without departing from the underlying idea of the present disclosure as is defined in the accompanying claims.

The invention claimed is:

1. An electrical connector for connecting a plurality of conductor pairs, wherein the electrical connector has:

a plurality of conductor pairs;

a metal housing which defines a first region and a second region, and wherein each conductor pair of the plurality of conductor pairs runs through the first region and the second region; and an electrically conductive potting compound provided in the first region, wherein the second region has metal borders which begin at a boundary between the first and second region and between which the plurality of conductor pairs is guided, and wherein the metal borders are configured and arranged to shield the plurality of conductor pairs from one another.

2. The electrical connector as claimed in claim 1, wherein each conductor pair of the plurality of conductor pairs is twisted in the first region.

3. The electrical connector as claimed in claim 1, wherein each conductor pair of the plurality of conductor pairs is at least partly untwisted in the second region.

4. The electrical connector as claimed in claim 1, wherein the first region has a cavity through which the plurality of conductor pairs is guided, wherein the cavity is provided with the potting compound, and wherein at least the plurality of conductor pairs is covered with the potting compound.

5. The electrical connector as claimed in claim 1, wherein the potting compound shields the plurality of conductor pairs from one another.

6. The electrical connector as claimed in claim 1, wherein the metal borders are part of the housing.

7. The electrical connector as claimed in claim 1, wherein the metal borders together with the housing define connection points of the electrical connector for an electrical connector that is complementary to the electrical connector.

8. The electrical connector as claimed in claim 1, wherein the potting compound is further provided in an initial region of the second region.

9. The electrical connector as claimed in claim 1, wherein the potting compound is a silver paste, nickel paste or a combination of the two.

10. The electrical connector as claimed in claim 1, wherein the metal borders are DC-coupled to the housing.

* * * * *